US008935835B2

(12) United States Patent
Fildan et al.

(10) Patent No.: US 8,935,835 B2
(45) Date of Patent: Jan. 20, 2015

(54) FASTENER FOR CLOTHING OR LINGERIE

(75) Inventors: Gerhard Fildan, Vienna (AT); Karl Wanzenboeck, Teesdorf (AT)

(73) Assignee: Fildan Accessories (HK) Ltd, Kwun Tong Hong Kong (CN)

( * ) Notice: Subject to any disclaimer, the term of this patent is extended or adjusted under 35 U.S.C. 154(b) by 0 days.

(21) Appl. No.: 13/994,001

(22) PCT Filed: Jan. 7, 2012

(86) PCT No.: PCT/EP2012/050200

§ 371 (c)(1),
(2), (4) Date: Jun. 27, 2013

(87) PCT Pub. No.: WO2012/093176

PCT Pub. Date: Jul. 12, 2012

(65) Prior Publication Data

US 2013/0269156 A1 Oct. 17, 2013

(51) Int. Cl.

| | |
|---|---|
| ***A44B 18/00*** | (2006.01) |
| ***A41F 1/00*** | (2006.01) |
| ***H01F 7/02*** | (2006.01) |

(52) U.S. Cl.

CPC ..... *A41F 1/002* (2013.01); *A41F 1/006* (2013.01); *H01F 7/0263* (2013.01)

USPC ..... 24/303; 24/578.1; 24/578.11; 24/669

(58) Field of Classification Search

CPC ..... A41F 1/002; A41F 1/006; A41F 15/002; A44D 2203/00; A41C 3/00; A44B 11/258; A44B 13/0047; E05C 19/16

USPC ..... 24/303, 578.1, 578.11, 584.1, 669

See application file for complete search history.

(56) References Cited

U.S. PATENT DOCUMENTS

| | | | |
|---|---|---|---|
| 6,298,527 | B1 | 10/2001 | Fildan et al. |
| 6,393,678 | B1 | 5/2002 | Fildan |
| 6,442,808 | B2 | 9/2002 | Fildan |
| 6,606,767 | B2 | 8/2003 | Wong |
| 6,622,349 | B2 | 9/2003 | Wong |
| 2010/0263173 | A1 | 10/2010 | Clarke et al. |

FOREIGN PATENT DOCUMENTS

| | | | |
|---|---|---|---|
| EP | 1219200 | A | 7/2002 |
| EP | 1264553 | A | 12/2002 |

*Primary Examiner* — Robert J Sandy
*Assistant Examiner* — David Upchurch
(74) *Attorney, Agent, or Firm* — Andrew Wilford

(57) ABSTRACT

A one-step fabric fastener has a front element (20) formed with a backwardly open seat cavity (21d) holding a magnet (22) and having a pair of catch faces (21*g*, 21*h*) directed away from one end of the front element, flanking the seat cavity, and angled such that front edges of the catch faces are closer to the one end than back edges of catch faces. The one end of the front element can exert traction on the front element and front magnet in a direction toward the one end. A back element (30) formed with a forwardly projecting bump (26*a*) holding a back magnet (27) is loosely fittable in the seat cavity has a pair of catch faces (26*c*, 26*d*) engageable in the direction with the front—element catch faces on engagement of the bump in the cavity. The magnets attract each other and pull the bump into the seat cavity on juxtaposition of the front and back element.

18 Claims, 5 Drawing Sheets

FASTENER FOR CLOTHING OR LINGERIE

FIELD OF THE INVENTION

The present invention relates to a fastener. More particularly this invention concerns a fastener for securing a textile part to another part, which may also be of textile, and in particular to a clothing or lingerie fastener.

BACKGROUND OF THE INVENTION

The simplest fastener for securing together two parts of a piece of clothing or lingerie is a hook or button or an array of such hooks or buttons.

In copending U.S. application Ser. No. 12/881,620 a magnetic brassiere back closure is described for securing together two garment strap ends having confronting faces. It has male elements mounted on the catch of one of the strap ends and a female element mounted on the face of the other strap end, generally complementary to the male element, and, with the faces touching or closely juxtaposed, slidably engageable in a fastening direction parallel to the faces with the male elements to fasten the two strap ends together. Respective male and female magnets on the strap ends are oriented so as to hold the strap ends in a finder position with their faces engaging or closely juxtaposed with each other and the male and female elements spaced in the direction and disengaged from each other so that displacement of the strap ends apart opposite to the fastening direction from the finder position will engage and lock together male and female elements.

Such an arrangement facilitates the actual closing or fastening operation but could stand improvement. In particular the closing operation is a two-step procedure of first generally aligning the elements in an opening/closing direction generally perpendicular to the plane of the fastener, and then shifting them in a fastening direction parallel to this plane. This action could be simplified.

OBJECTS OF THE INVENTION

It is therefore an object of the present invention to provide an improved fastener for clothing or lingerie.

Another object is the provision of such an improved fastener for clothing or lingerie that overcomes the above-given disadvantages, in particular that can be used as a brassiere back closure or to replace buttons, for example for a disabled person.

A further object is to provide a fastener or closure that can be fastened together in one step.

SUMMARY OF THE INVENTION

A fastener for connecting together two pieces of which at least one is a textile has according to the invention a front element formed with a generally cylindrical backwardly open cavity. This front element has a pair of catch faces directed away from one end of the front element, flanking the seat cavity, and angled such that front edges of the catch faces are closer to the one end than back edges of the catch faces. A front magnet is held in the front element immediately forward of the seat cavity, and the one end of the front element is connected to one end to pull the front element and front magnet in the fastening direction toward the one end. A male or back element is formed with a forwardly projecting generally cylindrical bump loosely fittable in the front-part seat cavity. The back element has a pair of catch faces generally complementary to the catch faces of the front element and engageable in the fastening direction therewith when the bump is engaged in the seat cavity. An end of the back element opposite the one end of the front element is connected to the other of the pieces to exert traction opposite to the fastening direction on the element away from the one end of the front element. A back magnet is secured in the bump. The magnets are so polarized as to attract each other and pull the bump into the seat cavity in the opening/closing direction on juxtaposition of the front and back elements.

With this system the two magnets automatically fit the two element of the fastener together. Once fitted together the angled catch faces transform a force pulling the two element apart parallel to the direction into a force urging the two element together perpendicular to this direction. Since there are two such catch faces flanking the magnets, there is no tendency of the fastener to tip or for its two element to spread, so that the fastener can withstand considerable forces. In practice the fastener can resist an opening force in the fastening direction parallel to the fastener of about 12 kg, while a much lighter separation force of only 2 kg in the opening direction perpendicular thereto can release the fastener.

Both of the magnets in accordance with the invention are substantially cylindrical and axially polarized perpendicular to the fastening direction. The magnets can be of the fairly powerful rare-earth type.

The back magnet is of substantially smaller diameter than the front magnet. This improves the self-centering action.

The front element according to the invention is formed by a catch ring surrounding and defining the seat cavity and the respective catch faces and a plurality of forwardly projecting pins and a front holder through which the pins pass and holding the front magnet. Such construction is inexpensive, since the parts can be cheaply produced from engineering plastic (nylon or POM) by injection molding so as to be very strong and light.

The front element is connected to the other piece by a textile layer pinched between the catch ring and the front holder. Such construction is very strong and allows this textile layer to serve also to hold the front magnet in place in the front element, thereby preventing direct contact between the front magnet and the wearer.

The catch ring of the front element has forwardly projecting spikes that engage through the textile layer that is sandwiched between the catch ring and the front element so as to solidly lock the front element to the textile layer. Furthermore this layer overlies the front magnet to wholly contain it and hold it out of contact with the wearer.

The bump is cup shaped, backwardly open, forwardly closed, and snugly surrounds the back magnet. In addition the back element is connected to the other piece by a textile layer or web covering a back surface of the back element and containing the back magnet in the cup-shaped bump. Again, the magnets are completely enclosed without using an extra part. Another textile layer overlies a front surface of the front element.

The front and back elements may comprise means to protect their respective magnets from moisture. These means form moisture-proof seals for the seat cavity in the front element and the rearwardly open cup of the bump of the back element, in which the magnets are respectively received.

BRIEF DESCRIPTION OF THE DRAWING

The above and other objects, features, and advantages will become more readily apparent from the following description, reference being made to the accompanying drawing in which.

SPECIFIC DESCRIPTION

In the following description the fasteners are described as being used between the back wings of a brassiere, and the terms "front" and "back" are used in that context. The invention however is not limited to such use or orientation, and would work equally well if reversed or applied to another application, for instance securing a luggage strap to a piece of luggage, to replace buttons, or as an auxiliary fastener such as next to the zipper of a ski parka, or even as a front brassiere-fastener.

The arrangement of FIGS. 1-8 is a fastener 10 for a full-figure or sports brassiere and has a row of five such fasteners 10 that together serve as the front closure between the cups or the back closure between the ends of the back wings of the brassiere. The fasteners 10 are identical except as described below for the polarities of their magnets, which alternate to ensure that they fit together properly.

Figure 1:
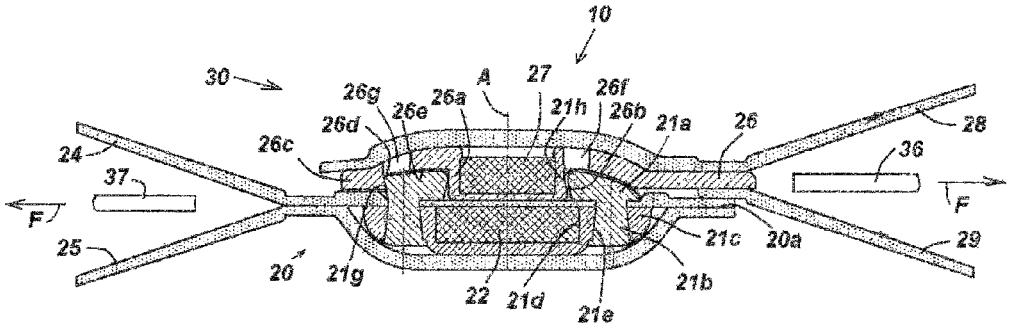
FIG. 1 is a large-scale section through a fastener according to the invention, connected together but not secured to a garment part.

More particularly as best shown in FIG. 1, each fastener 10 comprises a female front element 20 that normally lies directly against the wearer and a male back element 30 that is turned away from the wearer and that fits complementarily with the front element 20.

Figure 5:
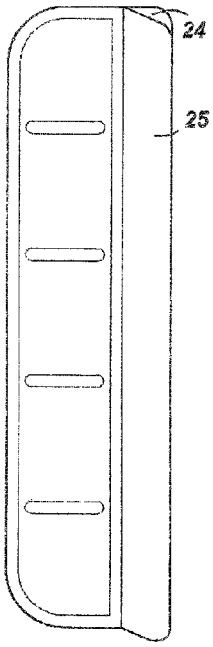
FIGS. 5 and 6 are front and back views of a tape carrying five of the female element of the fasteners according to the invention, usable for instance in a full-figure or sports brassiere.
Figure 6:
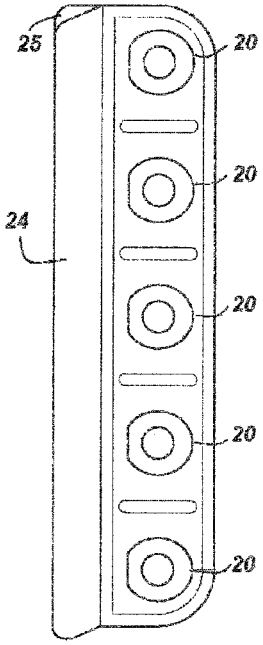
Figure 7:
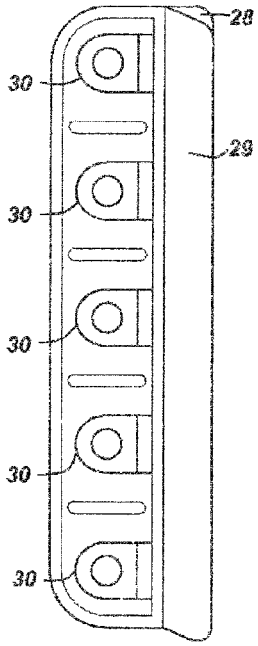
FIGS. 7 and 8 are front and back views of a tape carrying five of the male element of the fasteners according to the invention for use as in FIGS. 5 and 6.
Figure 8:
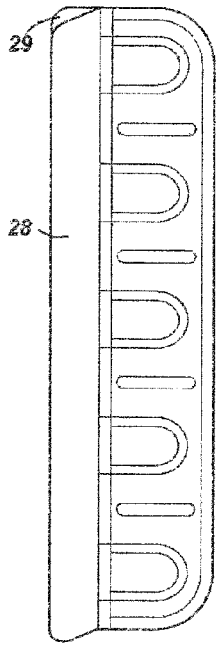
Figure 3:
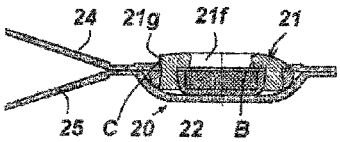
FIGS. 3 and 4 are smaller scale sectional views of the two element of the fastener, not connected together or secured to a garment part.
Figure 4:
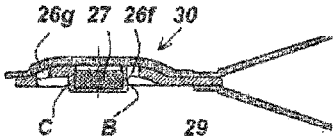
Figure 2:
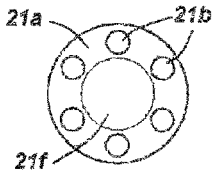
FIG. 2 is a detail view from the front of a front element of the fastener.
Figure 20:
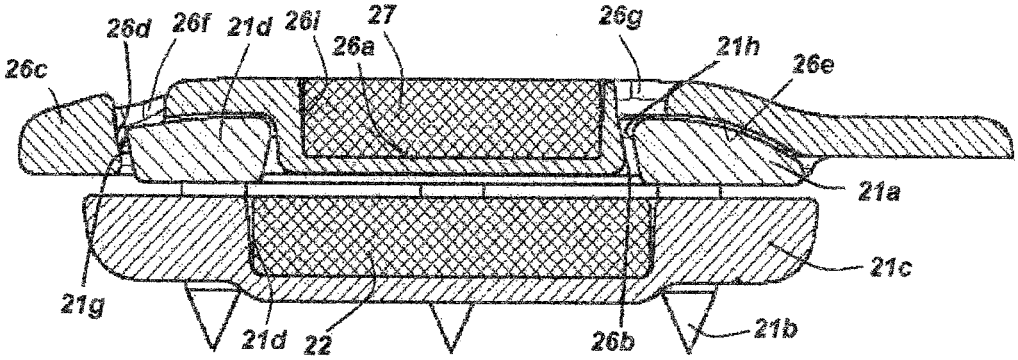
FIG. 20 is a view like FIGS. 1 and 9 of the fastener partially shown in FIG. 19, but with no textile parts.
Figure 21:
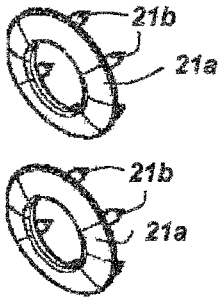
FIG. 21 is a small-scale perspective view showing the catch rings of the front elements of the fastener of FIG. 20.
Figure 22:
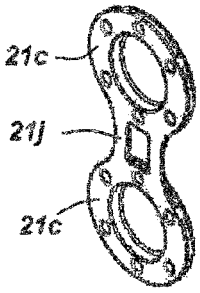
FIG. 22 is a small-scale perspective view of the magnet holders of the front elements of the fastener of FIG. 20.

The front element 20 has a two-part plastic body 21 shown alone in FIG. 2 and formed in part by a catch ring 21*a* from which a circular array of six angularly equispaced and parallel spikes or pins 21*b* extend forwardly. These pins 21*b* have, prior to assembly, (see FIGS. 9 and 20) pointed ends. The front element 21 is further formed by a holder 21*c* forming a backwardly open seat cavity 21*d* of cylindrical shape centered on an axis A. Around the seat cavity 21*d* are six through-going holes 21*e* through which the pins 21*b* extend, with for assembly their pointed ends heated and flattened rivet style to hold the catch ring 21*a* and the holder 21*c* integrally together.

A small but powerful magnet 22 fills the seat cavity 21*d* and a below-described textile web 24 overlies the back face of the holder and this magnet 22, gripped between the catch ring 21*a* and the holder 21 *c*. This also ensures that the magnet 22 never directly touches the wearer.

The catch ring 21*a* has a central hole that forms another rearwardly open cylindrical seat cavity 21*f* that is coaxial with the seat cavity 21*d* but of smaller diameter and whose floor is defined by the textile web 24 covering the magnet 22. The catch ring 21*a* holds the web 24 down on the magnet 22 and the spike/pins 21*b* poke through this web 24. The annular inner periphery of the catch ring 21*a* is flared toward the magnet 22 so as to be undercut and a portion of this periphery forms to one side of the seat cavity 21*f* a flat tangentially extending catch face 21*h*. In addition the holder 21*c* has to the diametrally opposite side of the seat cavity 21*f* a flattened outer edge 21*d* forming another catch face 21*g* similarly angled inward toward the front and parallel to the catch face 21 *h*. Both the catch faces 21 *g* and 21 *h* are directed inward away from the free end of the female element 20.

The two-piece element 21 is held between the above-mentioned textile layer or web 24 and another textile web or layers 24. These webs 24 and 25 each have on their side turned away from the other web an outer layer of woven or knitted fabric and an inner layer of fusible liner material, so that they form two flaps that can be ultrasonically welded to a strap or garment part 37 (FIG. 1) to solidly secure the front element 20 thereto. The two layers 24 and 25 are bonded together at 20*a* all around the holder 21*c* and magnet 22 so that it completely contains the holder 21 *c*, only leaving the catch ring 21 *a* exposed, and the magnet 22 is wholly contained. The outer layer can be whatever the garment is made of—cotton, silk, rayon, for example—and the inner layer is typically of a fusible or bondable synthetic resin such as nylon.

The back element 30 is of somewhat simpler construction having a one-piece plastic holder or part 26 forming a hollow cup shaped bump 26*a* that fits with slight play in the seat cavity or hole 21*f* and that in turn forms a rearwardly open and forwardly closed cylindrical seat cavity 26*i*. A front end edge of this bump 26*a* projects outward.

Another short cylindrical magnet 27 centered and polarized like the magnet 22 on the axis A fits complementary in this backwardly open cup 26*a*. The magnet 22 is 8 mm in diameter and 1.5 mm thick (measured axially) and is significantly bigger than the magnet 27 that measures 6 mm in diameter and 1.5 mm thick.

Figure 19:
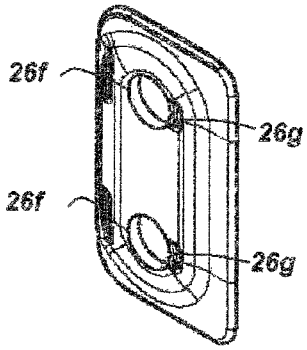
FIG. 19 is a small-scale perspective view of a back element of another fastener according to the invention.

An outer end 26*c* of the holder 26 has an inwardly angled catch face 26*d* that can lie flatly against the catch face 21*g* of the catch ring 21*a*. Similarly the bump 26*a* is formed on its side turned away from the end 26*c* with a flat catch face 26*b* that is planar and angled like the catch face 26*d* and spaced therefrom such that it can fit flatly against the catch face 21*h* while the catch face 26*d* engages the catch face 21*g*. Furthermore a front catch face of the holder 26 of the back element 30 is formed around the magnet-holding bump 26*a* with an annular recess 26*e* into which the front-element catch ring 21*a* engages and fits complementarily when the elements 20 and 30 of closure 10 are connected together. The back element 30 is also formed inward of the two catch faces 26*c* and 26*d* with respective throughgoing tangential slots 26*f* and 26*g* (see also FIGS. 19 and 20) that allow modest deformation of the holder 26 when connected up with the front element 20. These slots 26*f* and 26*g* are produced by punching in an operation that produces the catch faces 26*b* and 26*d*, the slots 26*f* and 26*g* having flat parallel side flanks that actually form these faces 26*b* and 26*d*.

The back catch face of the holder 26 is covered by a back textile layer 28 formed of two layers of a knit or woven textile sandwiching a fusible liner layer so that the magnet 22 is also wholly contained, and another layer 29 is attached at least to the inner end of the holder 26 to form a pair of flaps that can be bonded or stitched to a strap or garment part 36 (FIG. 1).

In use the magnets 22 and 27 are polarized such that they attract each other, to pull the smaller magnet 27 of the male element 30 into the hole 21*f*. When opposite forces as indicated at F are exerted on the two elements 20 and 30 via the flaps of their textile covers 24, 25 and 28, 29, the edge 26*b* fits and bears in a direction D against the catch face 21*h* of the hole 21*f* and the catch faces 26*d* and 21*g* similarly flatly engage each other, creating solid surface contact at two locations B and C flanking the axis A. The fact that the catch faces 26*d*, 21*g* and 26*b*, 21*h* extend at a small acute angle to the direction D of pull creates a vector of force that pulls the two elements 20 and 30 together parallel to the axis A, ensuring a very solid connection, capable of withstanding a force of at least 30 lb, which is more than a garment or brassiere is likely to be subjected to. Since this engagement is to both sides of the magnets 22 and 27, there is nothing to urge the magnets apart or to tip the closure. At the same time a transverse lifting of the element 30 from the element 20 easily separates them, but such lifting is, for instance, highly unlikely in a brassiere fastener that lies flatly against the skin underneath an outer garment.

FIGS. 5-8 show how five such fasteners 10 can be set in a row for an extremely strong resultant connection. The magnets 22 and 27 in both the female and male elements 20 and 30 are alternated with respect to polarity in opposite directions so that the two elements 20 and 30 need only be generally aligned before they snap together.

Figure 9:
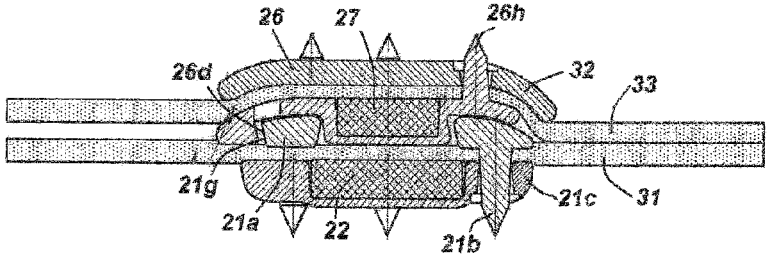
FIG. 9 is a section like FIG. 1 of another fastener according to the invention.
Figure 10:
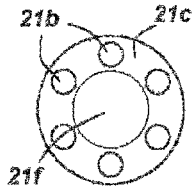
FIG. 10 is an end view of the front element of the fastener of FIG. 9.
Figure 15:
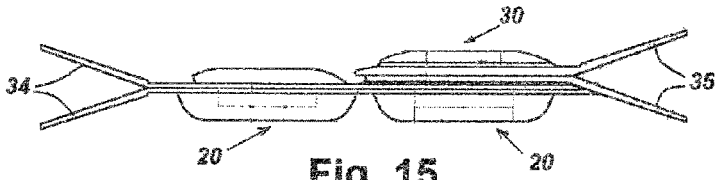
FIG. 15 is a side view of another fastener according to the invention.
Figure 16:
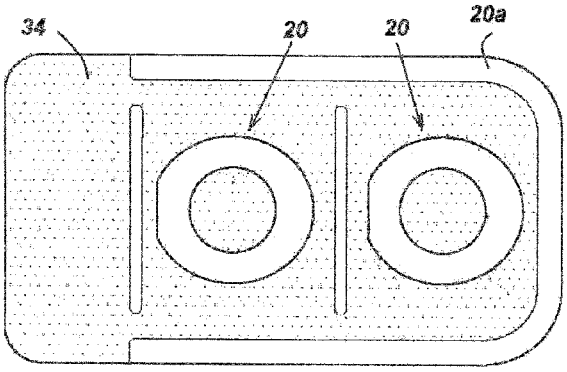
FIGS. 16 and 17 are views from the back of the two element of the FIG. 15 fastener separate from each other.
Figure 17:
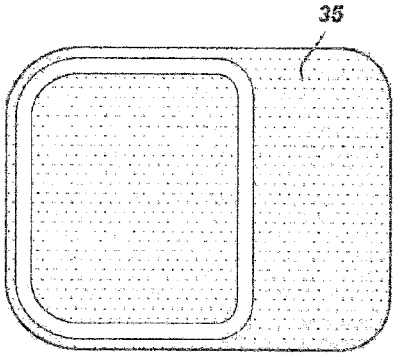
Figure 18:
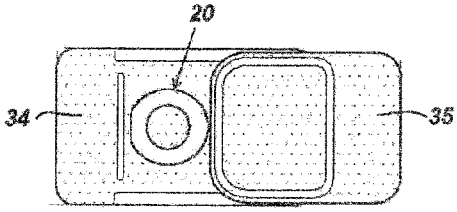
FIG. 18 is a view from the back of the fastener of FIGS. 15-17 when fastened together.

In the arrangement of FIGS. 9 and 10, a front layer 31 of textile is, as in FIG. 1, pinched between the catch ring 21*a* and the holder 21*c*, with the pins 21*b* poking through this layer 31. The resultant connection is very strong. Here there is a plastic back cap 32 secured by pins 26*h* projecting backward from the holder 26 through holes in the cap 32. The tips of the pins 26*h* can be fitted with rhinestones when they are fused to lock the holders 26 to the cap 32 for decorative effect. Another tape or web 33 extends between the cap 32 and holder 26 and is pierced by the pins 26*h* to solidly secure this web 33 in place.

Figure 11:
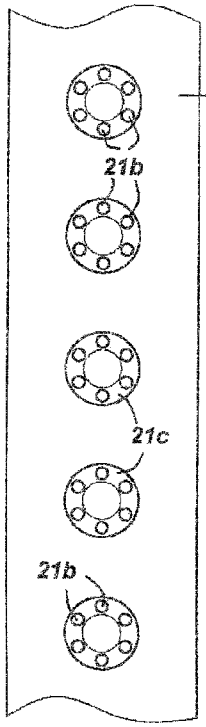
FIGS. 11 and 12 are back and front views of a tape carrying a number of the female element of the FIG. 9 fastener, as for instance supplied to a clothing fabricator who would use the fasteners as buttons.
Figure 12:
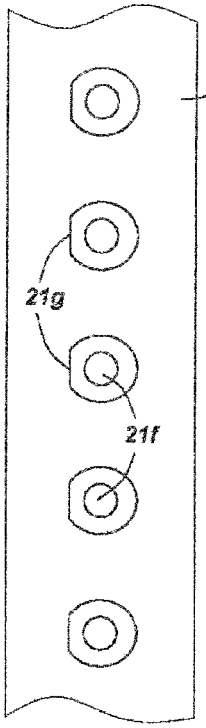
Figure 13:
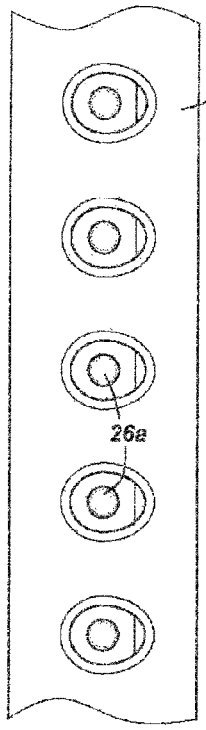
FIGS. 13 and 14 are front and back views of a tape carrying a number of the male element of the FIG. 9 fastener for use as in FIGS. 11 and 12.
Figure 14:
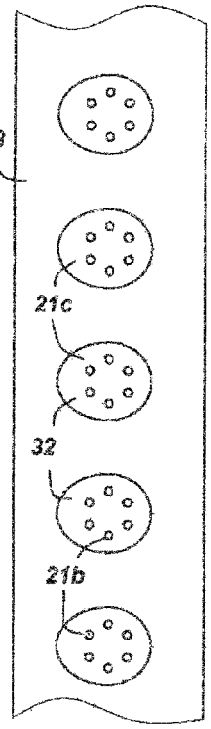

FIGS. 11-14 show the fastener as in FIGS. 9 and 10 mounted on tapes forming the webs 31 and 33. This is the format in which the fasteners according to the invention are provided for use instead of buttons or as utility fasteners, as the tape can simply be cut into sections each having one or more of the fasteners and installed in a garment or elsewhere as needed. The elements are typically spaced about 25 mm apart on the tapes, but the spacing can easily be varied between 20 and 200 mm. In practice the tapes as shown in FIGS. 11 and 14 are hidden when the fastener is installed by an the garment in which they are mounted.

FIGS. 16-19 show a system constructed as described above where two of the female elements 20 are longitudinally offset from each other on a common tape 34 and a single male element 30 is carried on another such tape 35. This, allows a length adjustment of the fastener, something that is quite handy on a brassiere or belt.

FIGS. 19-22 show a dual brassiere-back fastener where two of the back elements 30 fit with two or more of the front elements. As shown here the catch rings 21*a* with their pins/prongs 21*b* are separate plastic parts, but the two holders 21*c* are unitarily formed and interconnected by a central bridge or bar 21*j* to maintain their spacing constant. In the dual fastener the magnets of each fastener 10 are oppositely polarized so that the user cannot accidentally only connect one of the fasteners. The stiff bridge 21*j* prevents the two magnets carried by the rings 21*c* from folding together and sticking to each other.

Figure 23:
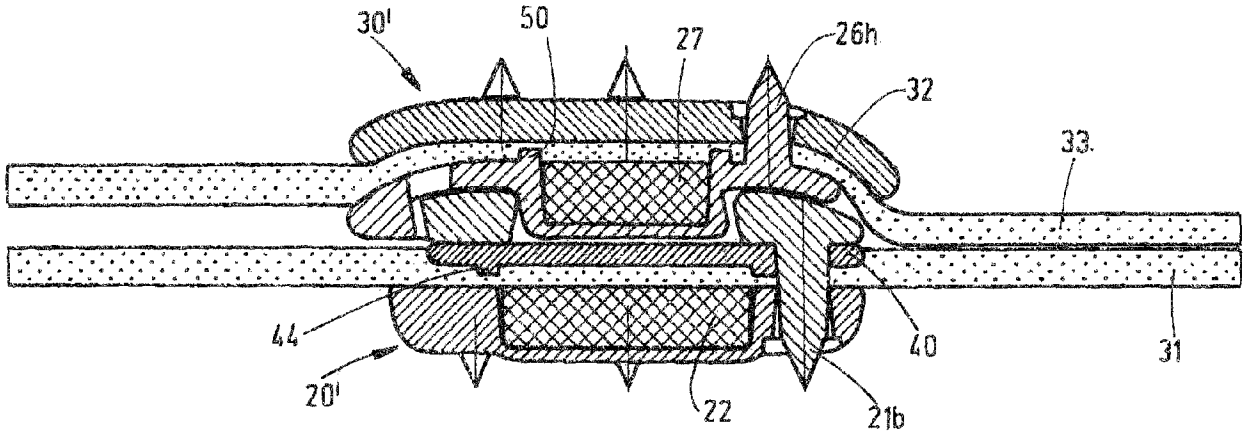
FIGS. 23 to 25 are sectional views of a further embodiment of the fastener which incorporates means to protect the magnets of the front and back elements from moisture.
Figure 25:
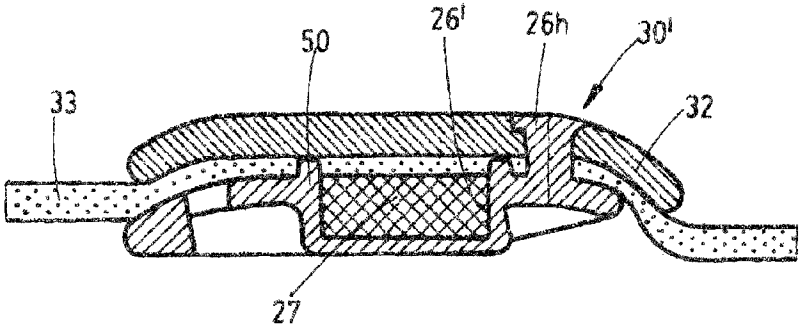
Figure 24:
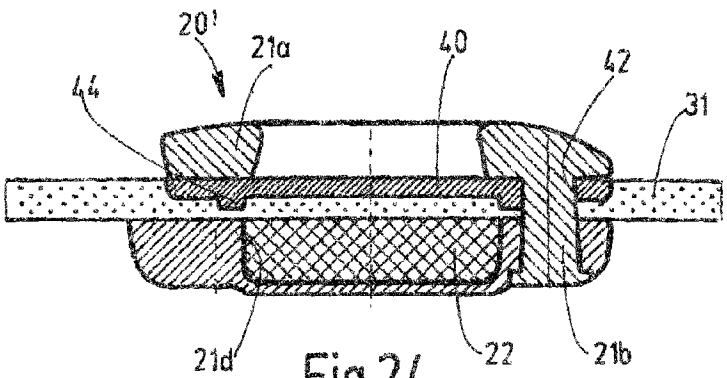

FIGS. 23-25 show an embodiment of the fastener which is generally constructed as described above with reference to FIG.

9, but which has additional means to protect the magnets 22, 27 in the front and back elements from moisture, such as perspiration, air humidity or washing liquid, to prevent the magnets from oxidizing or corroding due to exposure to such moisture. To this end the front element 20' further includes a generally disk-shaped sealing element 40 which has a plurality of openings 42 through which the plurality of forwardly projecting pins 21*b* of the catch ring 21*a* pass. The sealing element has on its forward facing surface a preferably annular or polygonal ridge 44 having a diameter which is larger that the diameter of the seat cavity 21*d* for the magnet 22 but wholly lies within the area circumscribed by the openings for the pins. That is to say that when the front element 20' is connected to the one piece, where a textile layer is pinched between the catch ring 21*a* and the holder 21*c*, the catch ring 21*a* and the sealing element are arranged on one side of the textile layer and the front holder 21*c* is arranged on the other side of the textile layer, though it is also conceivable to arrange only the catch ring 21*a* on one side of the textile layer and the sealing element and front holder 21*c* on the other side of the textile layer. In either case, when the front element 20' is assembled, the forwardly projecting ridge will be pressed against an area of the front holder 21*c* surrounding the seat cavity 21*d* for the magnet, so that the magnet is sealed within its cavity, thus preventing the ingress of moisture.

The back element 30' comprises a backwardly projecting, preferably annular or polygonal rib 50 which surrounds the opening of the cup 26*i* in which the magnet 27 is received. The purpose of this rib is the same as that of the ridge on the sealing element of the front element 20'. When the back element 30' is connected to the other piece, a textile layer is pinched between the back element 30' and the cap 32 and the two parts are fused together by way of the pins 26*h* of the back element, thereby pressing the rib against the forwardly facing surface of the cap 32 and providing a moisture-proof seal for the magnet 27 within the cup 26*i* of the back element 30'.

In all embodiments the magnets are shown cylindrical. They can also be other shapes, such as oval or polygonal.

The invention claimed is:

1. A fastener for connecting together two pieces of which at least one is a textile, the fastener comprising:

a front element having a catch ring forming a generally cylindrical backwardly open seat cavity, and having a pair of catch faces directed away from one end of the front element, flanking the seat cavity, and angled such that front edges of the catch faces are closer to the one end than back edges of the catch faces, a plurality of forwardly projecting pins, a front holder through which the pins pass, and a disk-shaped sealing element between the catch ring and the front holder and having a plurality of openings through which the pins pass;

a front magnet held by the front holder in the front element immediately forward of the seat cavity;

means for connecting the one end of the front element to one of the pieces to exert traction on the front element and magnet in a direction toward the one end;

a back element formed with a forwardly projecting generally cylindrical bump loosely fittable in the seat cavity, the back element having a pair of catch faces generally complementary to the catch faces of the front element and engageable in the direction therewith on engagement of the bump in the seat cavity;

means for connecting an end of the back element to the other of the pieces to exert traction opposite to the direction on the element away from the one end of the front element; and a back magnet secured in the bump, the magnets being so polarized as to attract each other and pull the bump into the seat cavity on juxtaposition of the front and back elements.

2. The fastener defined in claim 1 wherein both of the magnets are axially polarized perpendicular to the direction.

3. The fastener defined in claim 1 wherein the back magnet is substantially smaller than the front magnet.

4. The fastener defined in claim 1 wherein the means for connecting the front element to the one piece is a textile layer pinched between the catch ring and the front holder.

5. The fastener defined in claim 4 wherein the catch ring has forwardly directed pins projecting through the textile layer and seated in the front holder.

6. The fastener defined in claim 5 wherein the front element is of plastic.

7. The fastener defined in claim 4 wherein the textile layer forms a pair of flaps between which the one piece is secured.

8. The fastener defined in claim 1 wherein the sealing element has an annular or polygonal ridge facing in the direction of the front holder and having a diameter which is larger than the diameter of the seat cavity.

9. The fastener defined in claim 1 wherein the means for connecting the front element to the one piece is a textile layer pinched between the catch ring and sealing element on one side and the front holder on the other side.

10. The fastener defined in claim 1 wherein the means for connecting the front element to the other piece includes another textile layer overlying a front face of the front element.

11. The fastener defined in claim 1 wherein the bump is cup shaped, backwardly open, forwardly closed, and snugly surrounds the back magnet.

12. The fastener defined in claim 11 wherein the back element has a backwardly projecting annular or polygonal rib which encloses the opening of the cup formed by the bump.

13. The fastener defined in claim 11 wherein the means for connecting the back element to the other piece is a textile layer covering a back surface of the back element and containing the back magnet in the cup-shaped bump.

14. The fastener defined in claim 13, further comprising a cap rearwardly closing the seat cavity of the back element and containing the back magnet, the textile layer being sandwiched between the cap and the back element; and pins on the back element extending rearward through the textile layer and seated in the cap.

15. The fastener defined in claim 13 wherein the textile layer forms a pair of flaps between which the one piece is secured.

16. The fastener defined in claim 11 wherein the back element is formed with a pair of generally parallel throughgoing slots each having a flank forming a respective one of the back catch faces.

17. A fastener assembly having two of the fasteners according to claim 1 and further comprising:

a front support web on which both of the front elements are mounted spaced apart transversely of the direction; and a back support web on which both of the male element are mounted spaced apart transversely of the direction, the magnets of the front elements being oppositely polarized and the magnets of the elements being also oppositely polarized.

18. The assembly defined in claim 17, further comprising a stiff bridge interconnecting and unitarily formed with the front elements.

* * * * *